US007607242B2

(12) United States Patent
Karandonis et al.

(10) Patent No.: US 7,607,242 B2
(45) Date of Patent: Oct. 27, 2009

(54) FOOTWEAR

(75) Inventors: John Fotis Karandonis, 2 Urunga Street, North Balgowlah, New South Wales (AU) 2093; Kaye Eve Karandonis, North Balgowlah (AU)

(73) Assignees: John Fotis Karandonis, North Balgowlah, New South Wales (AU); Stanley Chris Stylis, Marrickville, New South Wales (AU); Daphe Anne Stylis, Marrickville, New South Wales (AU)

( * ) Notice: Subject to any disclaimer, the term of this patent is extended or adjusted under 35 U.S.C. 154(b) by 0 days.

(21) Appl. No.: 10/598,288

(22) PCT Filed: Nov. 21, 2005

(86) PCT No.: PCT/AU2005/001765

§ 371 (c)(1),
(2), (4) Date: Jul. 14, 2008

(87) PCT Pub. No.: WO2007/056791

PCT Pub. Date: May 24, 2007

(65) Prior Publication Data

US 2008/0263896 A1 Oct. 30, 2008

(51) Int. Cl.
*A43B 11/00* (2006.01)

(52) U.S. Cl. ..... 36/105; 36/50.1

(58) Field of Classification Search ..... 36/105, 36/50.1, 102, 50.5, 118.2, 97, 112
See application file for complete search history.

(56) References Cited

U.S. PATENT DOCUMENTS

| | | | | | |
|---|---|---|---|---|---|
| 2,452,502 | A * | 10/1948 | Tarbox | 36/87 |
| 2,568,974 | A * | 9/1951 | Tarbox | 36/12 |
| 3,192,651 | A * | 7/1965 | Smith | 36/105 |
| 4,095,356 | A | 6/1978 | Robran et al. | |
| 5,127,170 | A | 7/1992 | Messina | |
| 5,184,410 | A * | 2/1993 | Hamilton | 36/105 |
| 5,570,523 | A * | 11/1996 | Lin | 36/112 |
| 6,189,239 | B1 * | 2/2001 | Gasparovic et al. | 36/102 |
| 6,594,921 | B2 * | 7/2003 | Laio et al. | 36/138 |
| 2002/0095823 | A1 * | 7/2002 | Laio et al. | 36/138 |
| 2003/0200680 | A1 * | 10/2003 | Chang | 36/69 |

FOREIGN PATENT DOCUMENTS

AU 200165534 B2 3/2002

(Continued)

OTHER PUBLICATIONS

Derwent Patent Abstract Accession No. 2004-597983/58, JP2004236860 A (Kawase) Sep. 26, 2004 See entire abstract.

*Primary Examiner*—Marie Patterson
(74) *Attorney, Agent, or Firm*—Sughrue Mion, PLLC

(57) ABSTRACT

A shoe (1), having a toe section (2), and a heel section (3). The heel section (3), either totally or partly detachable from the toe section (2). Once at least partly detached, the shoe may be easily slipped onto the foot of a wearer, without the wearer having to bend or apply pressure to their foot to install or remove the shoe. In the embodiments in which the shoe is partly detached, the heel section (3) may be rotated relative to the toe section (2), either sideways or downwards. The detachable fastening means (4) may incorporate zippers, Velcro™ or other fastening means.

10 Claims, 14 Drawing Sheets

FOREIGN PATENT DOCUMENTS

| | | | |
|---|---|---|---|
| DE | 24 61 701 | | 11/1976 |
| DE | 24 61 701 | A1 | 11/1976 |
| DE | 38 35 035 | A1 | 7/1989 |
| DE | 3835035 | A1 | 7/1989 |
| DE | 41 07 376 | A1 | 3/1992 |
| DE | 41070376 | A1 | 3/1992 |
| DE | 296 08 693 | U1 | 9/1996 |
| DE | 296 078 693 | U1 | 9/1996 |
| DE | 298 09 404 | U1 | 9/1998 |
| EP | 1 430 802 | A1 | 2/2004 |
| EP | 1 430 802 | A1 | 6/2004 |

* cited by examiner

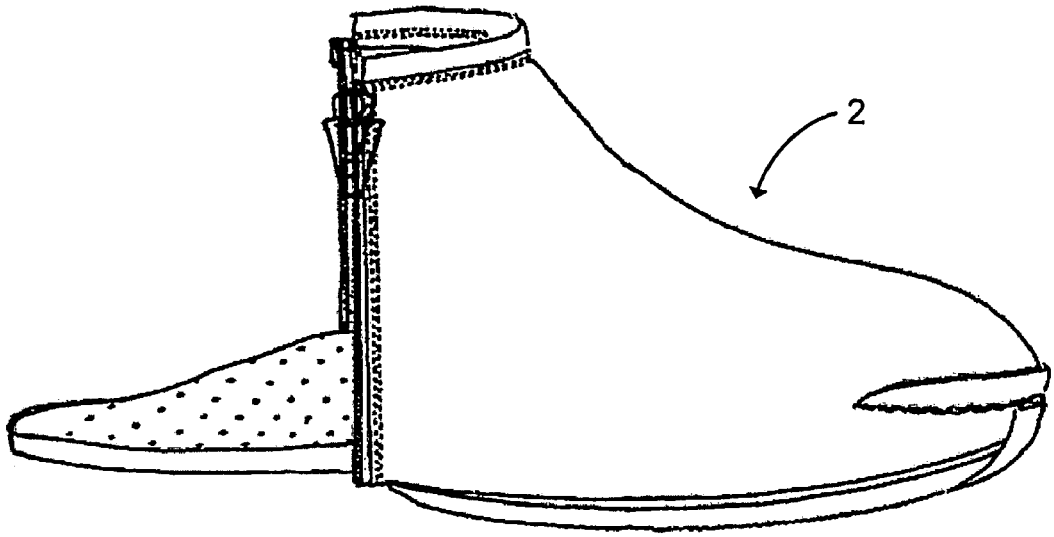
FIGURE 13(a)
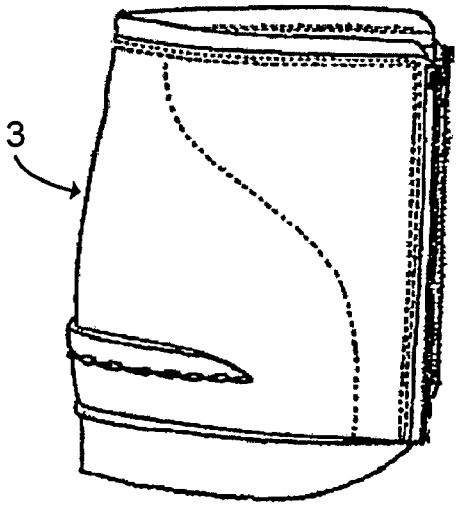
FIGURE 13(b)
FIGURE 13

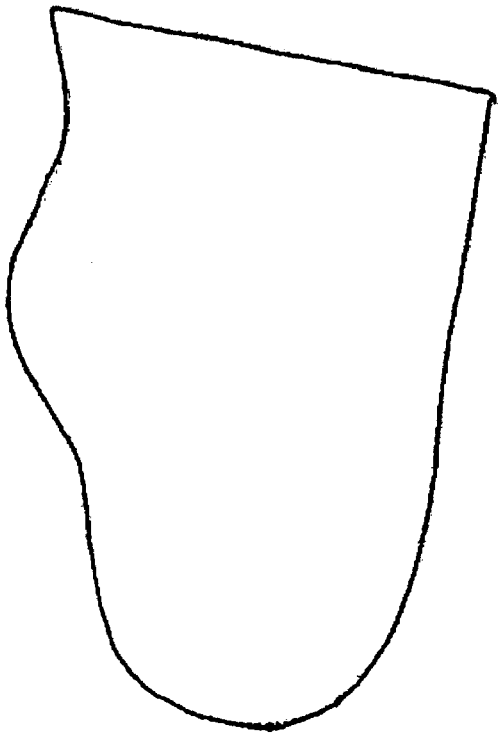
FIGURE 15(a)
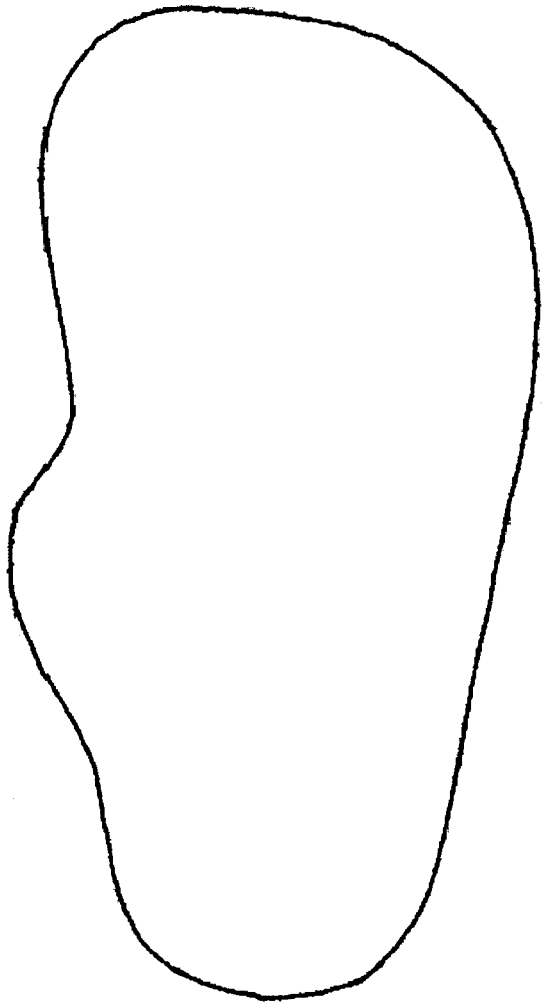
FIGURE 15(b)
FIGURE 15

FOOTWEAR

BACKGROUND OF THE INVENTION

The present invention relates to footwear, and in particular, to enclosed-style footwear in which the heel section may be at least partly detached from the toe section thereof, such that the footwear may be easily slipped on or off the foot of the wearer.

DESCRIPTION OF THE PRIOR ART

The reference to any prior art in this specification is not, and should not be taken as, an acknowledgement or any form of suggestion that that prior art forms part of the common general knowledge in Australia.

In general, footwear may be described as being either sandal-style type or enclosed-style. Conventional sandal-style footwear usually has a strap attached to the back to retain the sandal on a user's foot. Such sandal-style footwear is more readily slipped on or off the foot of a wearer, than enclosed-style footwear.

Enclosed-style footwear provides better support for the ankle and heel of the foot, due to the snug fit, with increased height of the footwear and a smaller foot opening. Enclosed-style footwear, however, is generally characterised in that the foot opening 11, when installed on the foot of a wearer, is smaller than the wearer's foot. To place the footwear on or off the foot of the wearer, a fastening device is required, such that, when taking enclosed-style footwear on or off, the fastening device is undone. Such a fastening device is more traditionally a lace or buckle or zipper, but nowadays, often incorporates hook and loop fastening means (known as Velcro™).

To place this enclosed-style footwear on, the fastening device must be undone. The foot is normally maneuvered into the footwear by twisting the ankle such that the toes are initially pointed whilst the foot is inserted into the footwear, and then, again the heel is twisted and the foot is returned from the pointed position whilst pushing the wearer's heel into the heel section of the footwear. This sequence is necessitated in order to negotiate the angle between the heel section and the shoe proper (front or toe part of the shoe). Once the toes and heel are both positioned into the footwear, the fastening means may then be fastened. Likewise, to take the footwear off, the reverse procedure is followed.

Whilst many persons are easily able to perform this task, some groups of persons have difficulty in placing on or taking off this enclosed-style footwear. Infants, small children, disabled or handicapped persons generally require assistance in doing this because they are unable or unknowing how to rotate their heels, point their toes, and apply the appropriate pressures to the toe and heel portions to ensure that the footwear is properly fitted.

This therefore identifies a need for a different or improved footwear which enable the various parts of the footwear to be at least partially detached, and to thereby enable the footwear to be slipped on or off more conveniently without the need for the usual type of rotation and force or pressure application to the foot of the wearer.

SUMMARY OF THE INVENTION

The present invention seeks to provide a footwear which overcomes the disadvantages of the prior art enclosed-style footwear.

Throughout this specification, the term shoe should be construed to encompass any type of footwear which is of an enclosed-style, as opposed to sandal-style. That is, it should be considered to encompass boots, runners and any like type of footwear. Likewise, when the term enclosed-style footwear is used, this should be considered to encompass footwear which may not totally enclose the toes or heels, but rather, could be partly open, have holes, slits or like patterns cut out of the footwear, but would not be classified as sandal-style footwear.

In one broad form, the present invention provides a shoe having a toe section and a heel section, characterised in that said heel section is at least partly detachable from said toe section.

Preferably, said heel section is totally detachable from said toe section.

Alternatively, but also preferably, said heel section is partly detached from said toe section, such that it can be rotated transversely relative to a plane extending substantially vertically through a longitudinal direction of said shoe.

Alternatively, but also preferably, said heel section is partly detached from said toe section, such that can be rotated transversely relative to a plane extending substantially horizontally through a longitudinal direction of said shoe.

Preferably, said heel section is at least partly detached from said toe section by means of any one or combination of detachable fastening devices including, but not limited to, zippers, Velcro (hook and loop fastening means), press studs, buckles and laces.

Also preferably, said shoe is constructed of any one of combination of materials including, but not limited to leather, plastics, textiles, rubber and synthetics.

Also preferably, said shoe is used for one or combination of applications, including, but not limited to infants, small children, disabled or handicapped persons.

Also preferably, said shoe include any one or combination of an arch support, insole support, and ankle support.

In a further broad form, the present invention provides a method of placing a shoe on the foot of a wearer, the shoe including a toe section, a heel section, and a fastening device for at least partially detaching said heel section from said toe section, the method including the steps of:

unfastening the fastening device;

twisting the heel section of the shoe relative to the toe section;

slipping the toes of the wearer into the toe section of the shoe;

returning the heel section of the shoe about the heel of the wearer; and, fastening the fastening device.

Preferably, in said twisting step, the heel section is twisted either or both of sideways or downwards relative to the toe section.

In a further broad form, the present provides a method of taking a shoe off the foot of a wearer, when the steps hereinbefore described are completed in reverse order.

BRIEF DESCRIPTION OF THE DRAWINGS

The present invention will become more fully understood from the following detailed description of preferred but non-limiting embodiments thereof, described in connection with the accompanying drawings, wherein:

FIG. 13 shows, in FIGS. 13(*a*) and 13(*b*) thereof, an exploded view of the embodiment of the footwear of FIGS. 11 and 12;

DETAILED DESCRIPTION OF PREFERRED EMBODIMENTS

Figure 1:
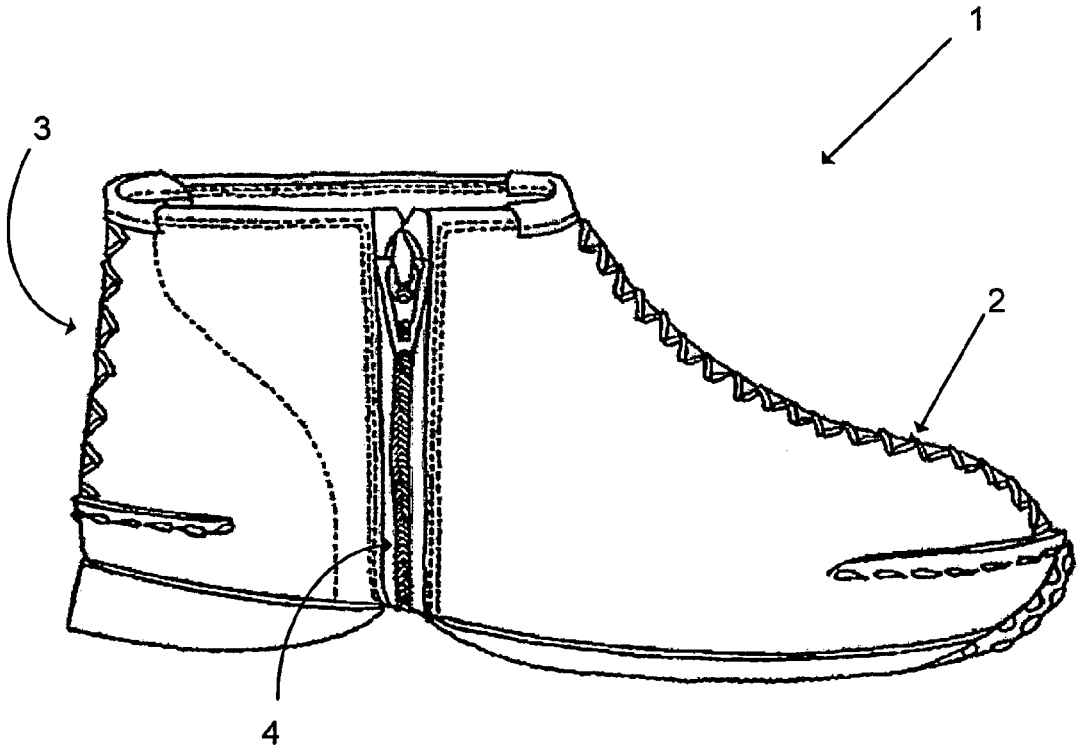
FIG. 1 shows a perspective view of a shoe in accordance with the present invention, looking from the outside of the shoe.
Figure 2:
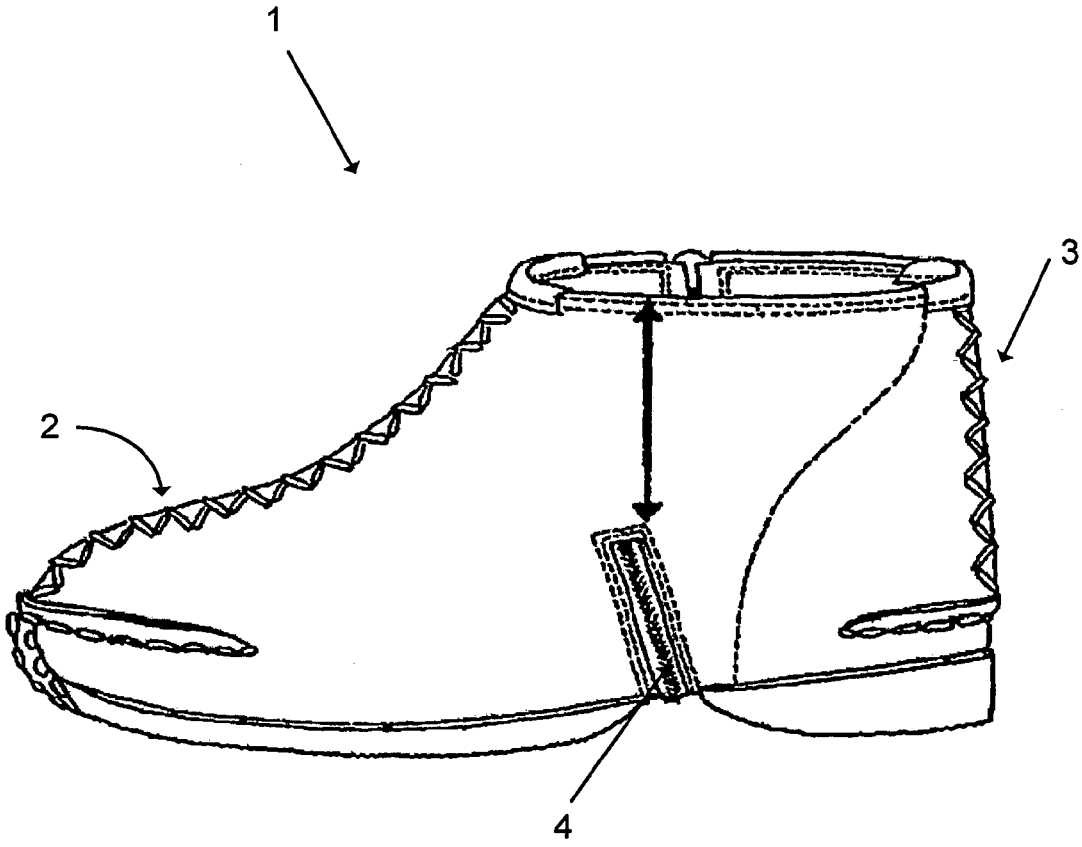
FIG. 2 shows a side perspective view of a shoe, looking from the inside.

A first embodiment of a shoe in accordance with the present invention is illustrated in FIGS. 1 to 6. These Figures illustrate a shoe, generally designated by the numeral 1, having a toe section 2, and a heel section 3. It will be seen that the toe section 2 is attached to the heel section 3, by means of a fastening means, which in this embodiment is configured as a zipper 4. FIG. 1 illustrates a view of the shoe 1 in the attached position, i.e. with the zipper 4 closed, looking from the outside of the shoe, whilst FIG. 2 shows the same shoe from the inside view.

Figure 3:
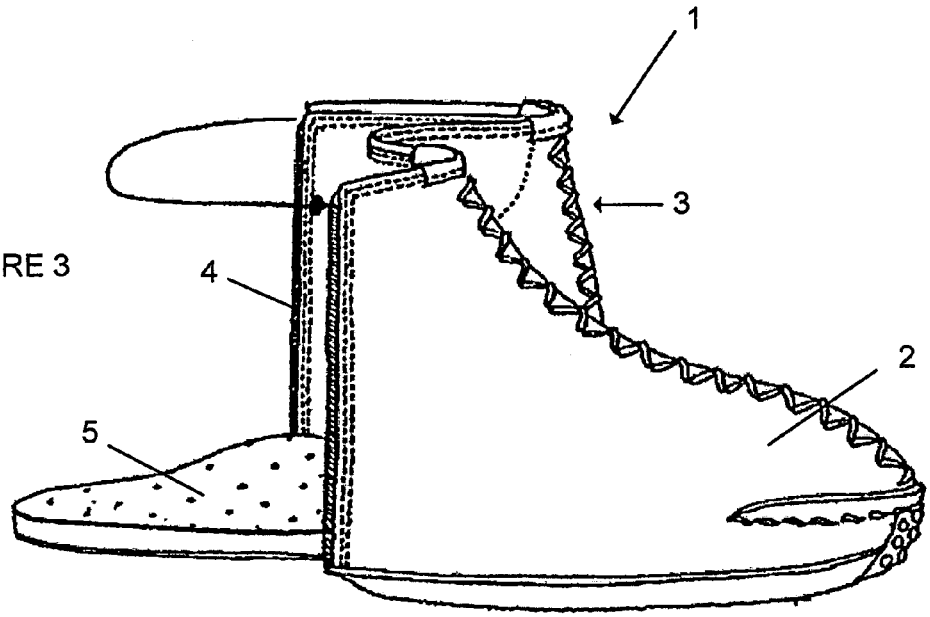
FIG. 3 shows the shoe of FIGS. 1 and 2, wherein the heel section is partially detached and rotated relative to the toe section of the shoe, looking from the outside of the shoe.
Figure 4:
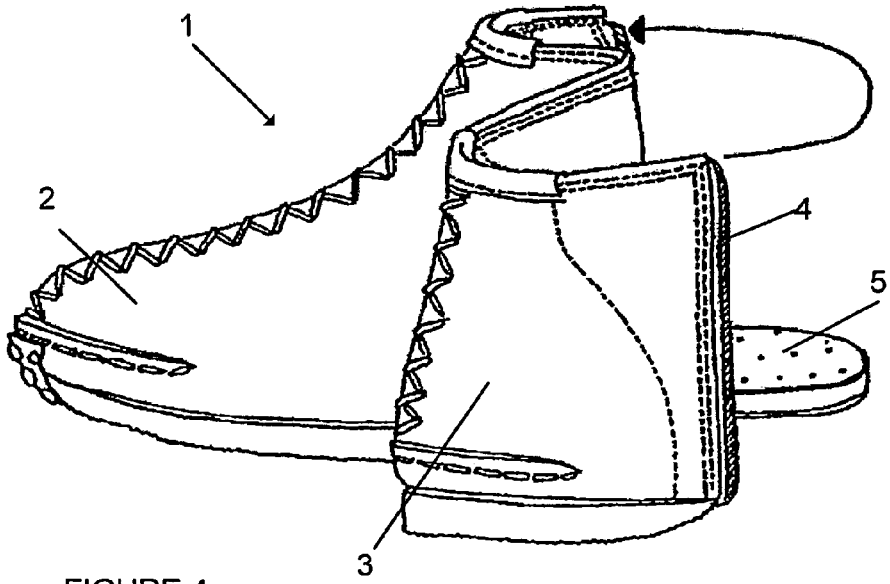
FIG. 4 shows the same shoe shown in FIG. 3, looking from the inside of the shoe.
Figure 5:
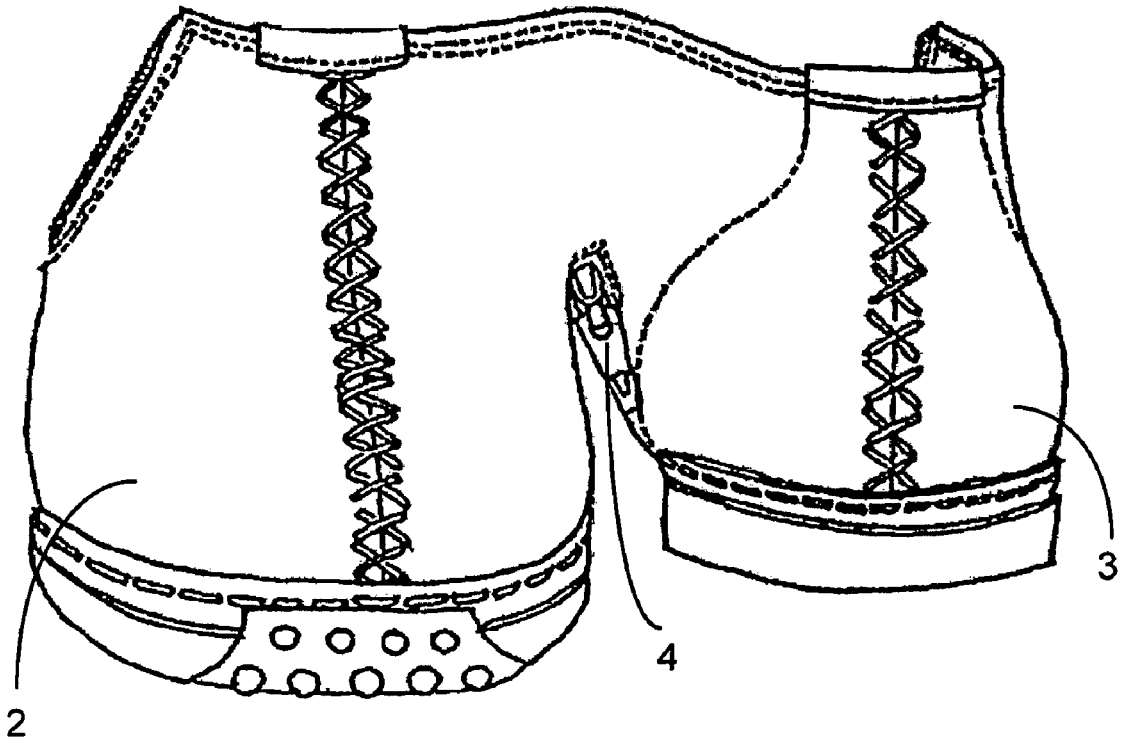
FIG. 5 shows the same view as FIGS. 3 and 4, looking from the rear of the shoe.
Figure 6:
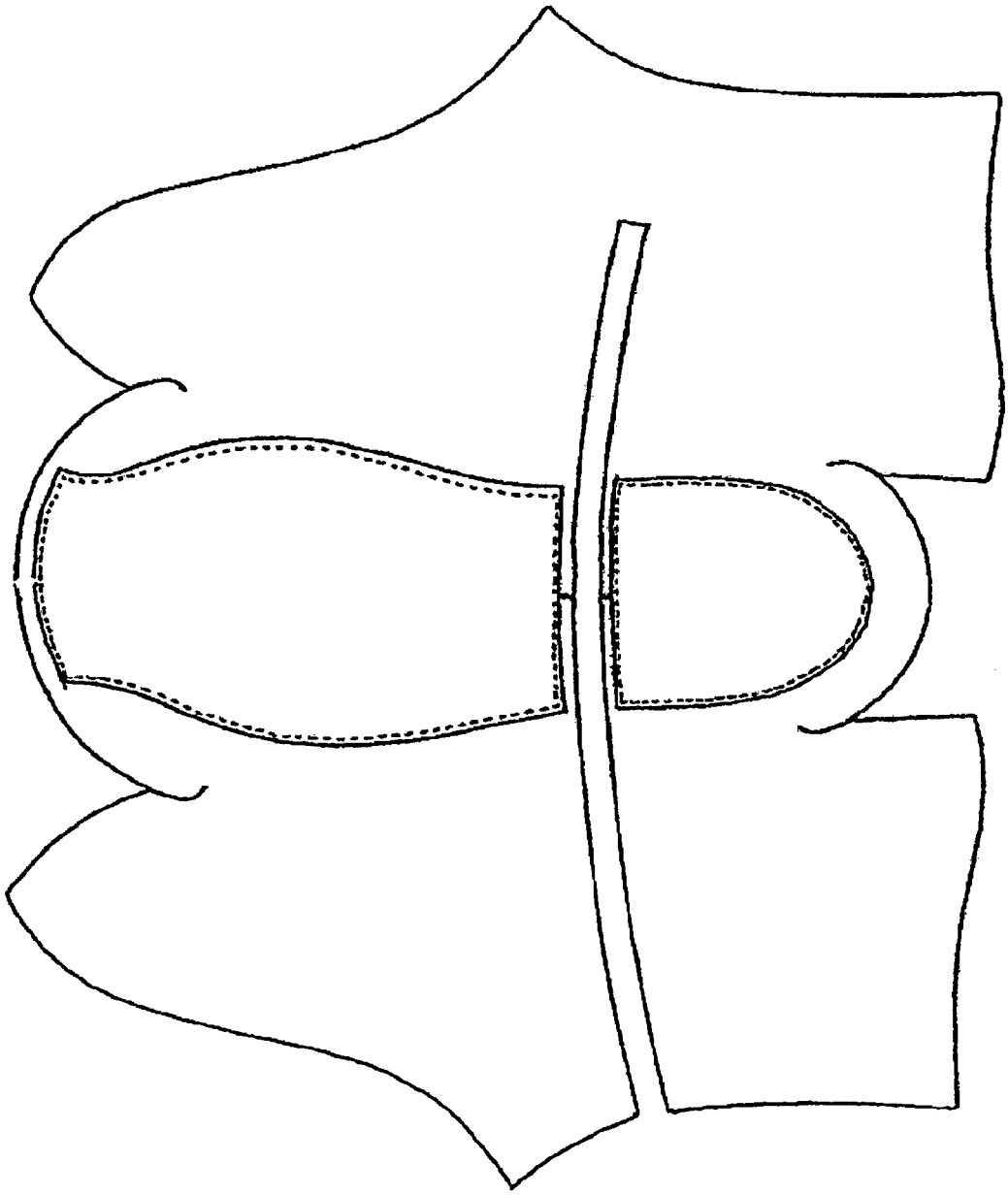
FIG. 6 illustrates a typical pattern for the upper and midsole of the shoe of FIGS. 1 to 5.

As illustrated in FIGS. 3, 4 and 5, the heel section 3 may be partly detached from the toe section 2, by undoing the zipper 4 or other fastening means. Once the fastening means 4 is undone, the heel section may then be twisted or rotated transversely out of the plane extending substantially vertically through a longitudinal direction of the shoe (in the attached position) to the position shown in FIGS. 3, 4 and 5. It will be appreciated that once the heel section 3 is rotated relative to the toe section 2, the foot of a wearer may be easily inserted into the toe section 2, and then, the heel section 3 may be re-rotated to surround the rear of the wearer's foot. The fastening means 4 or other zipper, may then be done up to reattach the heel section 3 to the toe section 2.

It will be appreciated that the shoe of this embodiment may be easily installed on the foot of an infant, small child, invalid or disabled or handicapped person without difficulty, and the zipper 4 may be easily done up. This may all be done without the requirement for the wearer to have to bend, twist and apply pressure to their toes, ankle or other parts of their foot as they usually do when having to place their foot into a conventional enclosed type shoe.

It will be appreciated by persons skilled in the art that variations and modifications to the embodiment hereinbefore described may be made. Such variations and modifications should be considered to be within the scope of the invention as herein described.

Figure 7:
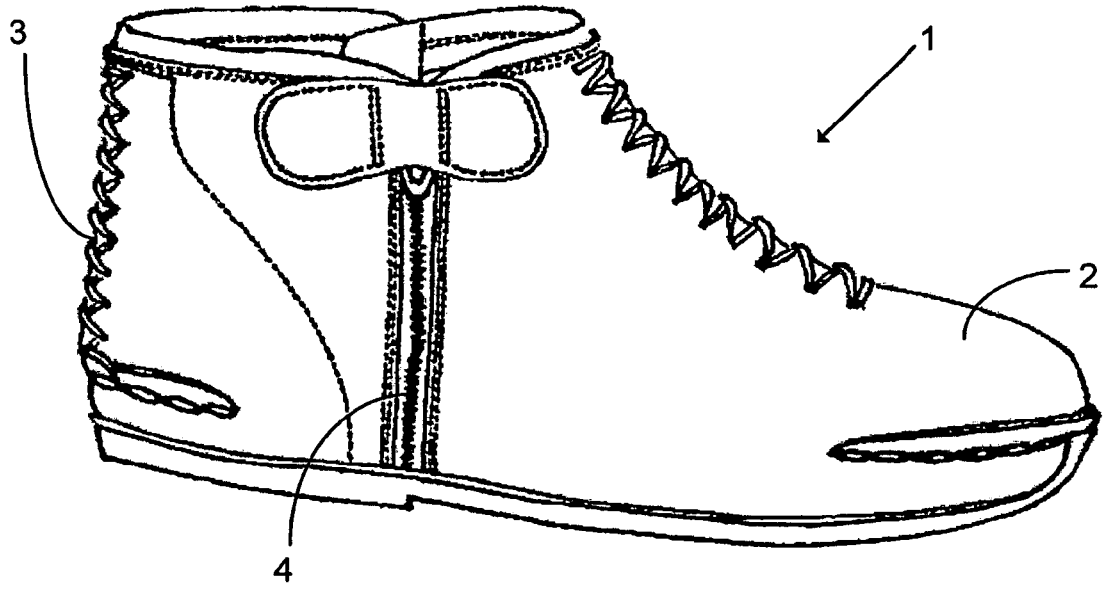
FIG. 7 shows an alternative embodiment of the shoe in accordance with the present invention.
Figure 8:
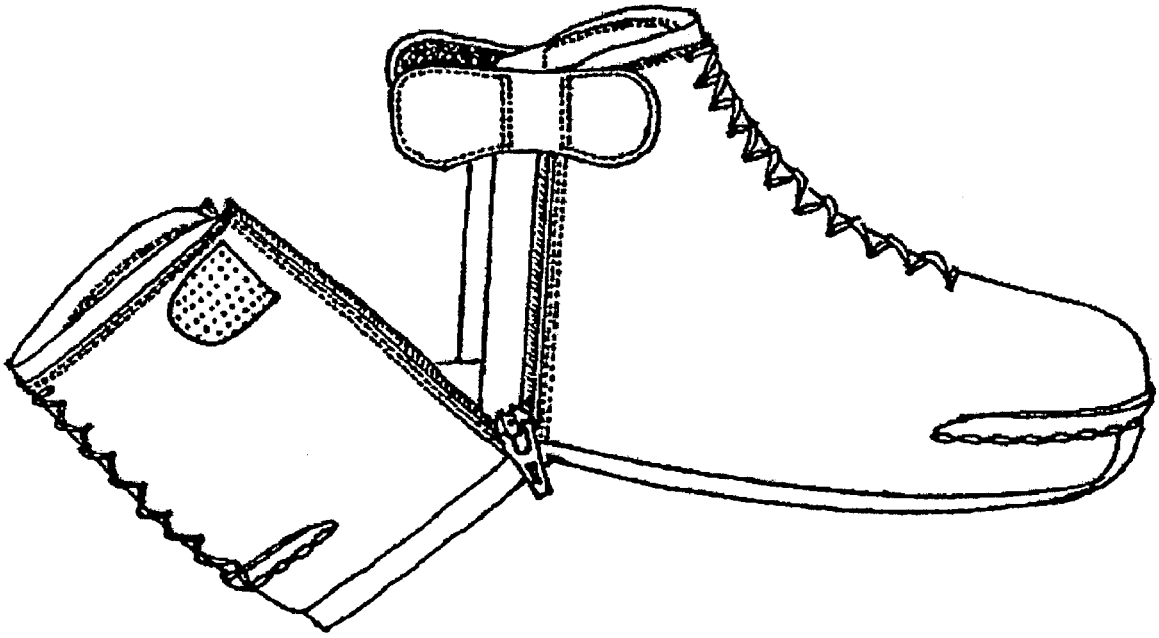
FIG. 8 illustrates the shoe of FIG. 7 wherein the heel section is partially detached and rotated relative to the toe section of the shoe.
Figure 9:
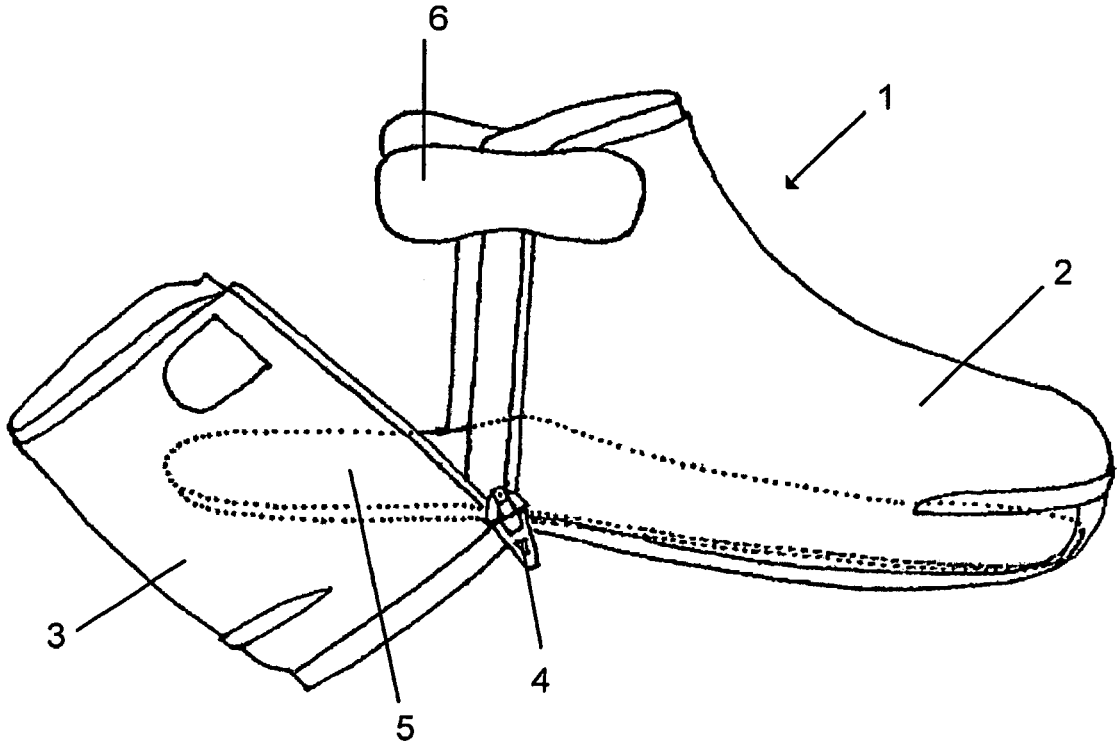
FIG. 9 illustrates a similar view of the shoe of FIG. 8, but showing the position of the insole.
Figure 10:
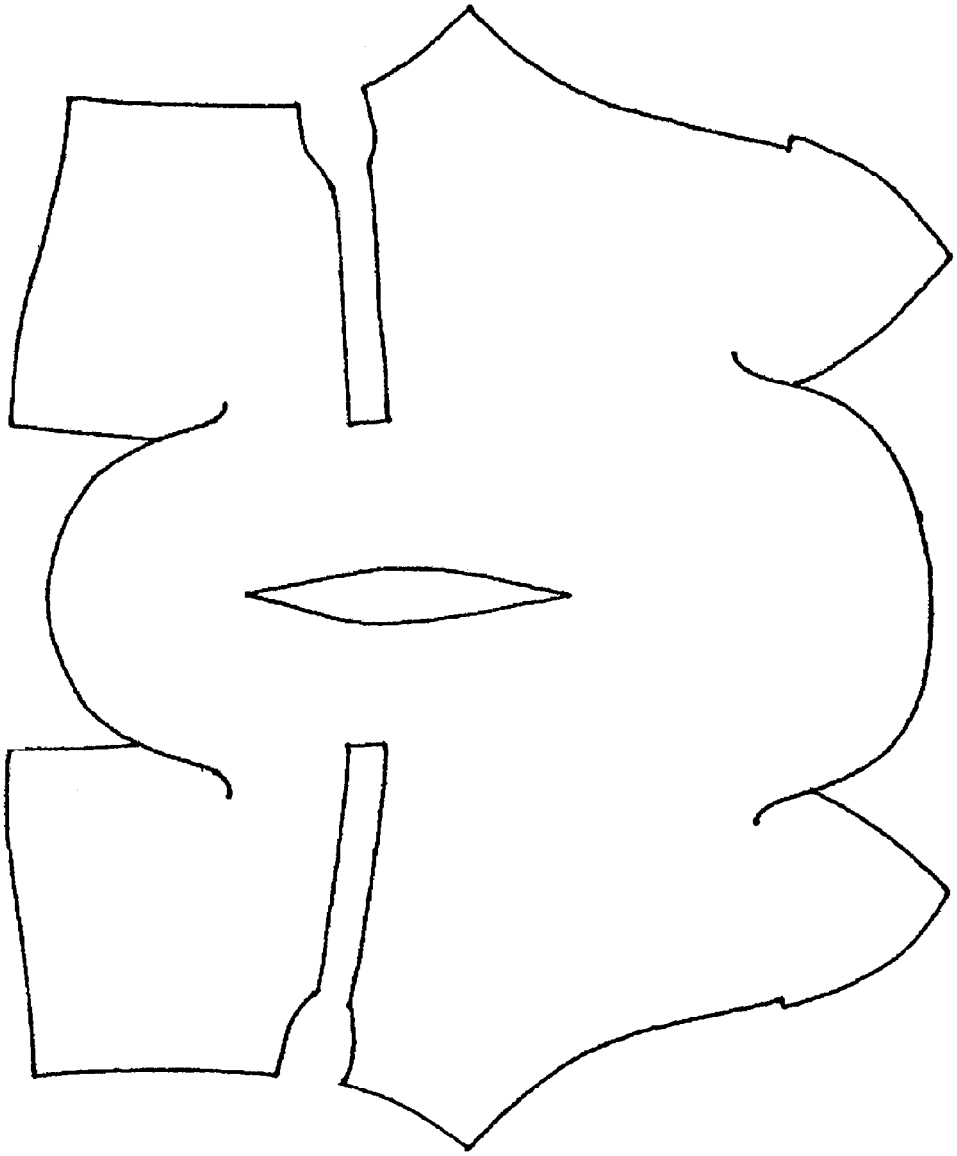
FIG. 10 illustrates the pattern of the upper of the shoe of FIGS. 7 to 9; and, FIG. 11 shows another alternative embodiment of a shoe in accordance with the present invention, looking from outside the shoe.
Figure 11:
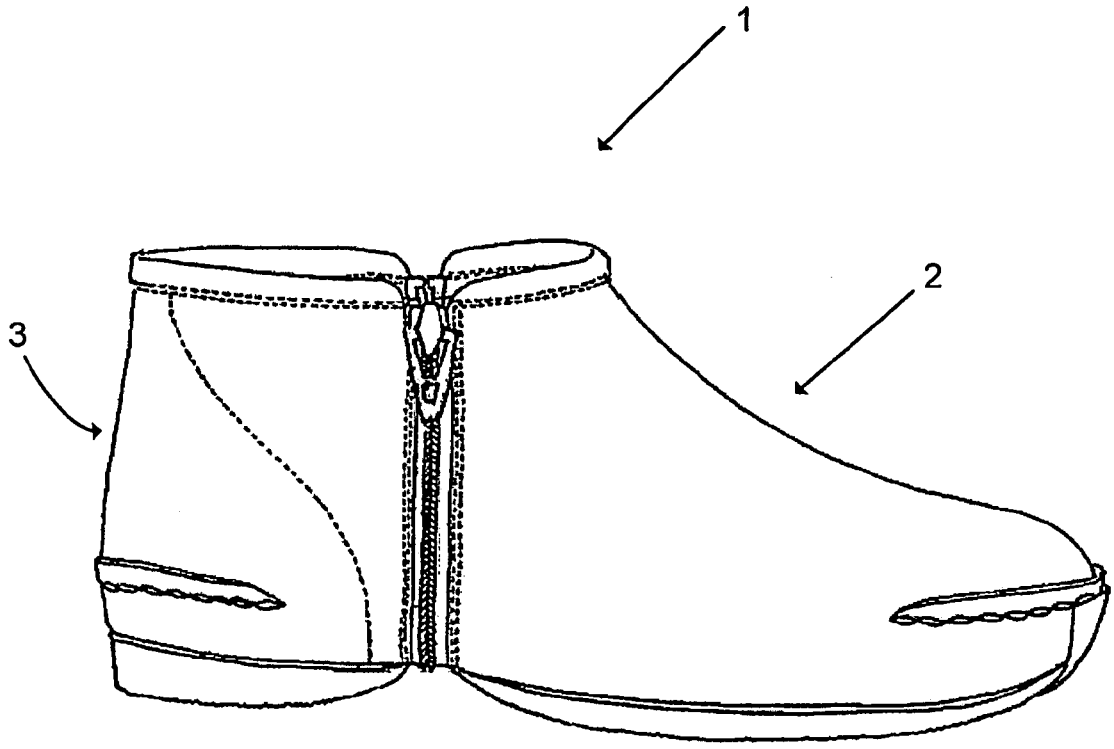
Figure 12:
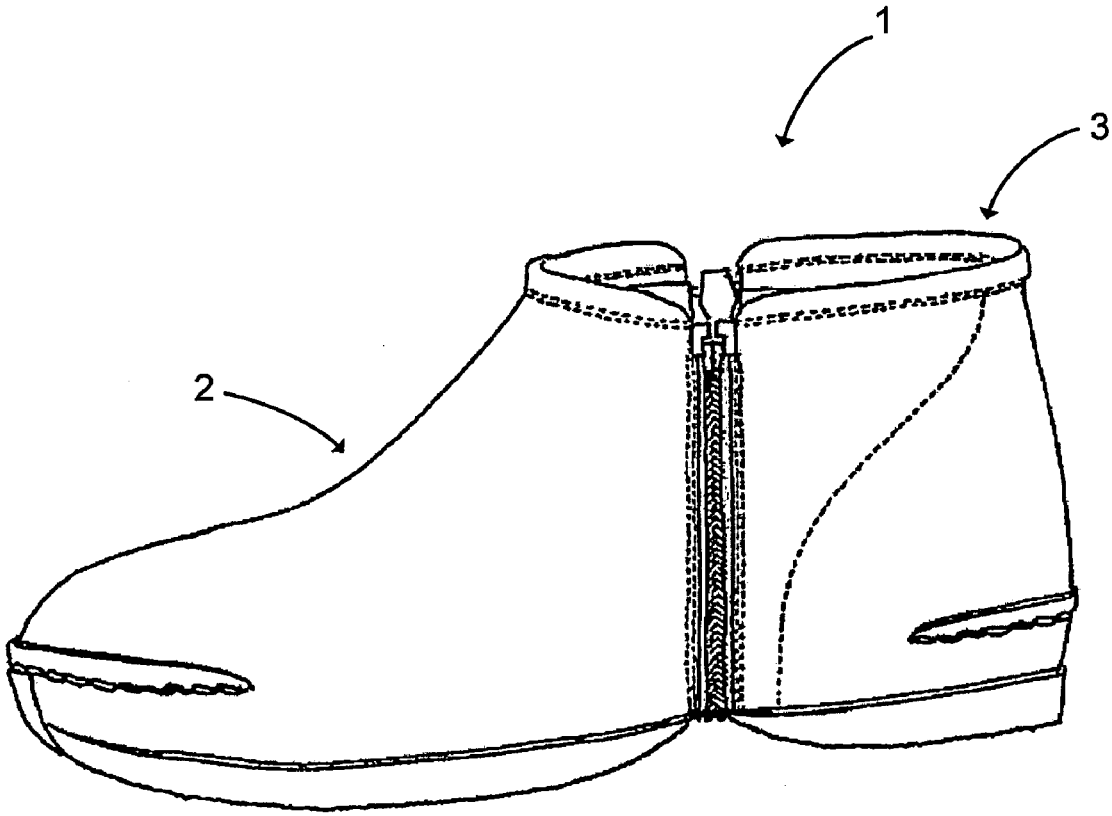
FIG. 12 shows the embodiment of FIG. 11, looking from inside the shoe.

For example, an alternative embodiment is illustrated in FIGS. 7 to 10, wherein the heel section 3 may be rotated downwardly relative to the toe section 2, as perhaps best illustrated in FIGS. 8 and 9. That is, in this case, the heel section 3 is again partly detached from the toe section 2 by undoing the zipper 4. The heel section 3 is this time rotated transversely relative to the plane extending substantially horizontally through a longitudinal direction of the shoe to the position shown in FIGS. 8 and 9. FIG. 9 illustrates how an insole 5 will maintain its position in this embodiment, ensuring that the insole 5 still provides the required support once the shoe 1 is done up. As with the embodiment shown in FIGS. 1 to 6, the embodiment of FIGS. 7 and 10 is also able to be installed on the foot of the types of wearer hereinbefore described, without needing the wearer to have to bend, twist and apply pressure to their toes, ankle or other parts of their foot as per conventional enclosed-style footwear.

The embodiment of FIGS. 7 to 9 also incorporates a fastening tab 6, forming part of the fastening means 4, in addition to the zipper.

It will be appreciated in that in yet a further embodiment, the heel section may be totally detached from the toe section, by incorporated a zipper which extends right around the mid section of the shoe, such as illustrated in FIGS. 11 to 15.

Figure 14:
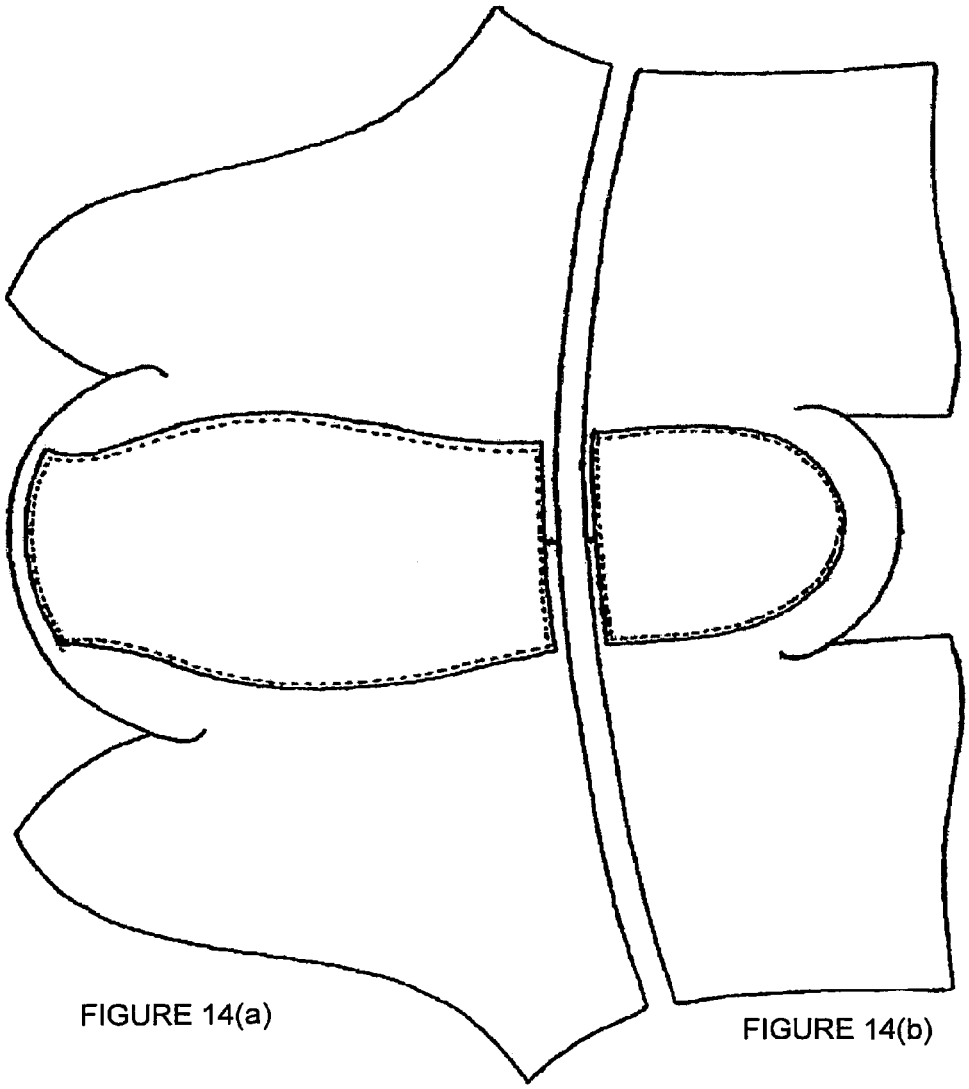
FIG. 14 shows in FIGS. 14(*a*) and 14(*b*) thereof, a pattern of the shoe shown in FIGS. 11 to 13; and, FIG. 15 shows, in FIGS. 15(*a*) and 15(*b*) thereof, patterns of shoe components of the shoe of FIGS. 11 to 14.

FIG. 13 perhaps best illustrates a 'totally detachable' form of footwear, wherein it can be clearly seen that the zipper 4 or other fastening device extends entirely about the mid-section of the footwear, FIG. 13(*a*) illustrating the toe-section 2, and FIG. 13(*b*) illustrating the heel-section 3. FIGS. 14 and 15 illustrate details of this embodiment of the footwear, with FIG. 14(*a*) showing the position of the midsole on the toe portion of the shoe upper, FIG. 14(*b*) showing the position of the midsole heel on the heel-section of the shoe upper, FIG. 15(*a*) illustrating a supportive contoured shank of the insole component of the shoe, and, FIG. 15(*b*) showing a leather covered, padded overlay of the insole components of the shoe of this embodiment.

Whilst each of the embodiments hereinbefore described have shown the use of a zipper, and whilst the second embodiment hereinbefore described also incorporates a Velcro tab, it will be appreciated that the attachment and detachment of the heel section from the toe section of the shoe may be facilitated by a variety of fastening means. Such fastening means may include one or more zippers, hook and loop fastening means (known as Velcro™), tabs or overlay, press stud, buckle, lace, or any combination of the above. Other fastening means which are known or become apparent to persons skilled in the art should also be considered to be incorporated within the scope of this invention.

It should also be noted that, depending on the embodiment implemented, alteration of the soles is inherent from those of conventional footwear. In particular, it will be noted that the external sole will either be constructed in two separate parts, as per the first and third embodiments hereinbefore described, or, in one part which permits it to bend or fold downwards, as per the second described embodiment. It will also be noted that the inner sole (insole) may, in any of these described embodiments, still be of unitary construction and be attached to the toe section 2 of the shoe. This unitary construction enables better support to the foot of the wearer than if constructed in two parts.

It should also be noted that, with the external sole constructed in the manner hereinbefore described, and with the inner sole also constructed in a manner such that it can also easily fold or be flexible, the wearer will be able to flex his ankle forward more readily than in conventional shoes, whilst still being supported. This may have improved performance in certain applications, for instance, in certain sports. That is, with the soles virtually hinged, the heel will not lift out of the shoe as it typically does when walking fast or running in conventional shoes.

It will also be appreciated that the shoe of the present invention may be constructed of a variety of materials. Suitable materials include leather, plastics, textiles, rubber, synthetic materials, and the like. It will be appreciated that there should be no limitation to the type of material which is utilised for constructing this shoe. That is, all suitable materials known to persons skilled in the art to be used for constructing footwear should be incorporated within the scope of the present invention.

As hereinbefore mentioned, the shoe of the present invention is particularly useful for infants, small children, disabled, handicapped, invalid persons, or persons with a foot injury, who might typically have difficulty in bending their foot as required to put on a conventional type enclosed shoe. However, the shoe may be conveniently utilised by any person, whether they have this physical limitation, or not. The shoe may also be utilised by sporting persons requiring the flexibility inherent in the design/features of the shoe of the present invention.

The shoe of the present invention therefore provides good ankle support whilst retaining the smaller opening of a conventional enclosed-style shoe, but has the advantage that it is easily fitted without twisting, turning or otherwise applying force to insert or remove the shoe from the foot of the wearer. It enables the wearing of a shoe with provision of needed ankle support for people who would not otherwise be able to wear a suitable shoe with such ankle support.

It will also be appreciated that the shoe of the present invention may incorporate traditional arch supports, insole supports and ankle supports, as per conventional type shoes, to achieve the usual purposes known to persons skilled in the art.

All further variations and modifications of the present invention which become apparent to persons skilled in the art, should be considered to be encompassed within the scope of the invention hereinbefore described.

The invention claimed is:

1. A shoe of the type having a substantially flexible upper and a substantially firm sole, the shoe including:

a toe section, including a forward sole portion and a forward upper portion for receiving a forward portion of a foot including at least toes thereof;

a heel section, including a rear sole portion and a rear upper portion for receiving a rearward portion of a foot including at least a heel thereof, said heel section being at least partially detachable from said toe section such that said heel section can be rotated relative to said toe section to allow a forward portion of the foot to be inserted into said toe section;

detachable fastening means for releasably attaching said heel section to said toe section; and an insole, of substantially unitary construction, which is retained in said toe section and which is adapted to overlay both the forward and rear sole portions of said shoe.

2. A shoe as claimed in claim 1, wherein said heel section is adapted to be partly detached from said toe section by being rotated transversely relative to a plane extending substantially vertically through a longitudinal direction of said shoe.

3. A shoe as claimed in claim 1, wherein said heel section is adapted to be partly detached from said toe section by being rotated transversely relative to a plane extending substantially horizontally through a longitudinal direction of said shoe.

4. A shoe as claimed claim 1, wherein said heel section is partly detached from said toe section by a detachable fastening devices including at least one of a zipper, hook and loop fastener, tabs, overlays, press studs, buckles and laces.

5. A shoe as claimed in any claim 1, wherein said shoe further comprises at least one of an arch support, insole support, and ankle support.

6. The shoe of claim 1, wherein toe section and said heel section are formed of a substantially unitary constructions.

7. A method of placing a shoe on the foot of a wearer, the shoe including:

a toe section, including a forward sole portion and a forward upper portion for receiving a forward portion of a foot including at least toes thereof;

a heel section, including a rear sole portion and a rear upper portion for receiving a rearward portion of the foot including at least a heel thereof, said heel section being at least partially detachable from said toe section such that said heel section can be rotated relative to said toe section;

detachable fastening means for releasably attaching said heel section to said toe section; and an insole, of substantially unitary construction, attached to said toe section and which is adapted to overlay both the forward and rear sole portions of said shoe;

said method including the steps of:

detaching the fastening means;

rotating said heel section relative to the toe section in a manner that the rear sole portion is moved out of alignment relative to said forward sole portion of said shoe, whilst said insole is retained within said toe section of said shoe;

slipping the toes of the wearer directly into said toe section from a rearward position to place the wearer's foot atop said insole;

returning said heel section of said shoe into alignment with said toe section and about the heel of the wearer; and, fastening the fastening means.

8. The method of claim 7, wherein toe section and said heel section are formed of a substantially unitary constructions.

9. A method as claimed in claim 7, wherein, in said twisting step, the heel section is rotated at least one of sideways and downwards relative to the toe section.

10. A method of taking a shoe off the foot of a wearer, the shoe including:

a toe section, including a forward sole portion and a forward upper portion for receiving a forward portion of a foot including at least toes thereof;

a heel section, including a rear sole portion and a rear upper portion for receiving a rearward portion of the foot including at least a heel thereof, said heel section being at least partially detachable from said toe section such that said heel section can be rotated relative to said toe section;

detachable fastening means for releasably attaching said heel section to said toe section; and an insole, of unitary construction, attached to said toe section and which is adapted to overlay both the forward and rear sole portions of said shoe;

said method including the steps of:

detaching the fastening means;

rotating said heel section relative to the toe section in a manner such that the rear sole portion is moved out of alignment relative to said forward sole portion of said shoe, whilst said insole is retained within said toe section of said shoe; and slipping the toes of a wearer directly out of said toe section in a rearward direction to remove the wearer's foot from atop said insole.

* * * * *

UNITED STATES PATENT AND TRADEMARK OFFICE

CERTIFICATE OF CORRECTION

PATENT NO. : 7,607,242 B2
APPLICATION NO. : 10/598288
DATED : October 27, 2009
INVENTOR(S) : John Fotis Karandonis and Kaye Eve Karandonis It is certified that error appears in the above-identified patent and that said Letters Patent is hereby corrected as shown below:

Title page, item (73) Assignees:

delete "Daphe Anne Stylis", insert --Daphne Ann Stylis--

Signed and Sealed this

Twenty-third Day of February, 2010

David J. Kappos

David J. Kappos
*Director of the United States Patent and Trademark Office*